US007344133B2

(12) United States Patent
Miki

(10) Patent No.: US 7,344,133 B2
(45) Date of Patent: Mar. 18, 2008

(54) SHEET FEEDING METHOD AND DEVICE AND IMAGE FORMING APPARATUS USING THE DEVICE

(75) Inventor: Katsuhiko Miki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 90 days.

(21) Appl. No.: 10/653,997

(22) Filed: Sep. 4, 2003

(65) Prior Publication Data

US 2004/0046310 A1 Mar. 11, 2004

Related U.S. Application Data

(63) Continuation of application No. 09/865,582, filed on May 29, 2001, now Pat. No. 6,631,899.

(30) Foreign Application Priority Data

May 29, 2000 (JP) ..... 2000-158235
Apr. 17, 2001 (JP) ..... 2001-117737

(51) Int. Cl.
*B65H 3/52* (2006.01)

(52) U.S. Cl. ..... 271/122; 271/125

(58) Field of Classification Search ..... 271/109, 271/114, 115, 116, 121, 122, 125, 95, 124; 400/629

See application file for complete search history.

(56) References Cited

U.S. PATENT DOCUMENTS 4,573,675 A * 3/1986 Svyatsky et al. ..... 271/122
4,632,376 A * 12/1986 DuBois ..... 271/4.1
4,858,907 A * 8/1989 Eisner et al. ..... 271/124
5,039,080 A * 8/1991 Kato et al. ..... 271/122
5,449,162 A * 9/1995 Saito et al. ..... 271/122
5,501,444 A * 3/1996 Yukimachi et al. ..... 271/127
5,575,467 A * 11/1996 Williams ..... 271/122
5,651,542 A * 7/1997 Yamauchi et al. ..... 271/122
5,882,002 A * 3/1999 Kamei et al. ..... 271/118
5,996,990 A * 12/1999 Kawashima ..... 271/122
6,000,689 A * 12/1999 Furuki et al. ..... 271/10.11
6,042,099 A * 3/2000 Takagishi ..... 271/2
6,059,280 A * 5/2000 Yamauchi et al. ..... 271/109
6,059,281 A * 5/2000 Nakamura et al. ..... 271/119

(Continued)

FOREIGN PATENT DOCUMENTS

EP 0 279 642 8/1988

(Continued)

OTHER PUBLICATIONS

U.S. Appl. No. 11/475,077, filed Jun. 27, 2006, Miki et al.

*Primary Examiner*—Patrick Mackey
*Assistant Examiner*—Jeremy Severson
(74) *Attorney, Agent, or Firm*—Oblon, Spivak, McClelland, Maier & Neustadt, P.C.

(57) ABSTRACT

A method of feeding sheets includes the step of conveying the sheets between a feed roller and a separation member. The separation member is pressed against and into contact with the feed roller with a pressure applied between the feed roller and the separation member. The method also includes the steps of separating and conveying the sheets conveyed between the feed roller and the separation member one by one, and providing a cyclic change in the pressure between the feed roller and the separation member.

1 Claim, 14 Drawing Sheets

U.S. PATENT DOCUMENTS

| | | | | | |
|---|---|---|---|---|---|
| 6,102,388 | A | * | 8/2000 | Thornhill | 271/119 |
| 6,135,442 | A | * | 10/2000 | Hirata et al. | 271/116 |
| 6,378,858 | B1 | * | 4/2002 | Suga | 271/10.01 |
| 6,467,767 | B2 | * | 10/2002 | Yano | 271/122 |
| 6,536,759 | B1 | * | 3/2003 | Takada | 271/125 |
| 6,585,253 | B1 | * | 7/2003 | Miki | 271/125 |
| 6,641,132 | B2 | * | 11/2003 | Sekine | 271/124 |
| 6,672,579 | B2 | * | 1/2004 | Araki et al. | 271/122 |
| 6,913,257 | B2 | * | 7/2005 | Takaki et al. | 271/125 |
| 6,997,453 | B2 | * | 2/2006 | Matsuda et al. | 271/122 |
| 2004/0046310 | A1 | | 3/2004 | Miki | |

FOREIGN PATENT DOCUMENTS

| | | | |
|---|---|---|---|
| GB | 2 012 727 | | 8/1979 |
| JP | 61-2629 | | 1/1986 |
| JP | 4-341435 | * | 11/1992 |
| JP | 5-201571 | | 8/1993 |
| JP | 5-201671 | * | 8/1993 |
| JP | 5-213468 | | 8/1993 |
| JP | 5-301547 | * | 11/1993 |
| JP | 5-330683 | | 12/1993 |
| JP | 6-100179 | | 4/1994 |
| JP | 6-156764 | | 6/1994 |
| JP | 10-279108 | | 10/1998 |

* cited by examiner

SHEET FEEDING METHOD AND DEVICE AND IMAGE FORMING APPARATUS USING THE DEVICE

CROSS REFERENCE TO RELATED APPLICATIONS

This is a continuation application of application Ser. No. 09/865,582, filed May 29, 2001, now U.S. Pat. No. 6,631,899. This application is related to and claims priority, under 35 U.S.C. § 119, from Japanese Patent Application Nos. 2000-158235 and No. 2001-117737, filed in the Japanese Patent Office on May 29, 2000 and Apr. 17, 2001, respectively and the entire contents of the parent application and both Japanese patent applications are hereby incorporated by reference herein.

BACKGROUND OF THE INVENTION

1. Field of the Invention

The present invention relates to a sheet feeding method and a sheet feeding device for image forming apparatuses, such as copying machines, printers, facsimile apparatuses, and printing apparatuses, and also relates to an image forming apparatus using the sheet feeding device.

2. Discussion of the Background

In image forming apparatuses, such as copying machines, printers, facsimile apparatuses, and printing apparatuses, sheets to be printed on are stacked in a sheet feeding part of the apparatuses and are separated one by one by a sheet feeding device of the apparatuses so as to be fed to an image forming part of the apparatuses. Known sheet feeding devices include feed and reverse rollers (FRR) type device, a friction roller (FR) type device, and a friction pad (FP) type device.

Recently, with the increase in the use of color images, a coated sheet having a superior smoothness has been widely used for sheets to be printed on in image forming apparatuses for obtaining a better image quality. The coated sheets tend to closely contact each other, either because of the smoothness of their surfaces or under the influence of humidity, in a sheet feeding part of image forming apparatuses, and thereby incomplete separation of the sheets occurs, resulting in double feeding of the sheets.

The following proposals are known with respect to improvement of sheet separation performance of sheet feeding devices of image forming apparatuses:

a) Japanese Patent Laid-Open Publication No. 5-201571 relates to a sheet feeding device which includes a feed roller rotating at a constant position and a separation member contacting the feed roller and in which sheets are fed into a nip between the feed roller and the separation member. For increasing the sheet separation performance, a vibrating member is arranged so as to contact the separation member at the backside thereof, and the separation member is vibrated by the vibrating member back and forth in a sheet feeding direction.

b) Japanese Patent Laid-Open Publication No. 5-213468 discloses that a mechanism for generating a force to stop conveyance of a sheet (i.e., the mechanism serving as a separation member) is elastically brought into contact with a rotating member (i.e., serving as a feed roller) rotating at a constant position. The separation member is vibrated by piezoelectric ceramics, so that the force to stop conveyance of a sheet by the separation member is freely suppressed and thereby, the sheet separation performance, corresponding to a change in the quality of sheets to be printed on, is obtained.

c) Japanese Patent Laid-Open Publication No. 5-330683 relates to a sheet feeding device in which a friction pad contacts a feed roller rotating at a constant position. For improving the separation performance, the friction pad is vibrated by a piezo-electric element so that the pressure of the friction pad is suppressed and the vibration is transmitted to the sheets to be printed on.

d) Japanese Patent Laid-Open Publication No. 6-100179 proposes to provide vibration, for increasing the sheet separation performance, to stacked sheets in a sheet feeding tray so that the stacked sheets are loosened.

In the above-described proposals a), b) and c), the separation member, which does not directly contact the sheet to be separated from the other sheets so as to be fed, is vibrated, and therefore the vibration is indirectly applied to the sheet to be separated in a thickness direction of the stacked sheets. Thereby, the sheet to be separated is not sufficiently vibrated, resulting in incomplete separation of the sheet. Also, in the above-described proposal d), the vibration is applied to the feeding tray, so that the sheet to be separated from the others to be fed is not directly vibrated, thereby resulting in incomplete separation of the sheet. Further, the vibration of the separation member by a high frequency wave does not provide the effect of the vibration over the entire part of a sheet. Therefore, the effect of loosening the stacked sheets is not sufficient to prevent non-feeding of the sheets.

SUMMARY OF THE INVENTION

The present invention has been made in view of the above-discussed and other problems and addresses the above-discussed and other problems.

Preferred embodiments of the present invention provide a novel sheet feeding method and a novel sheet feeding device that reliably prevents double feeding of sheets.

According to a preferred embodiment of the present invention, a method of feeding sheets includes the steps of: conveying the sheets between a feed roller and a separation member, the separation roller being pressed against and into contact with the feed roller, with a pressure applied between the feed roller and the separation member; and separating and conveying the sheets conveyed between the feed roller and the separation member one by one, wherein a cyclic change is provided in the pressure between the feed roller and the separation member.

In the above method, the cyclic change in the pressure may be provided from a side of the feed roller.

Further, the cyclic change in the pressure may be provided at a low frequency.

Furthermore, the feed roller may be cyclically pressed for providing the cyclic change in the pressure.

According to another preferred embodiment of the present invention, a sheet feeding device includes a feed roller and a separation member, wherein the separation member is pressed against and into contact with the feed roller with a pressure applied between the feed roller and separation member, and the sheets conveyed between the feed roller and the separation member, are separated and conveyed one by one. The sheet feeding device further includes a pressing device configured to cyclically provide a change in the pressure between the feed roller and the separation member.

In the above sheet feeding device, the pressing device may be arranged at a side of the sheets, where the sheets are separated and conveyed one by one. Further, the pressing device may be provided to the feed roller. Furthermore, the pressing device may include a cam. Still furthermore, the above sheet feeding device may include a driving system driving the feed roller, and the pressing device may include a driving motor independent of the driving system of the feed roller. In this case, the motor may be selectively driven. Further, a rotation speed of the motor may be variable.

Further, in the above sheet feeding device, the pressing device may use a magnetic force.

Furthermore, the above sheet feeding device may include a driving system driving the feed roller, and the pressing device may be driven by a driving force from the feed roller driving system.

Still furthermore, in the above sheet feeding device, the sheet separation member may be one of: 1) a friction pad which is elastically pressed against and into contact with the feed roller; 2) a friction roller which is upwardly and elastically supported by an axis, the axis being rotated by a driving gear and a gear engaged with the driving gear and supported at one side thereof, and the friction roller being arranged at a free end side of the axis via a torque limiter, so as to be rotated only in a sheet feeding direction; and 3) a reverse roller which is upwardly and elastically supported by an axis, the axis being rotated by a driving gear and a gear engaged with the driving gear and supported at one side thereof, the reverse roller being arranged at a free end side of the axis via a torque limiter, so as to be rotated in a sheet feeding direction and a direction opposite the sheet feeding direction.

According to another preferred embodiment of the present invention, a sheet feeding device includes a feed roller and a reverse roller, wherein the reverse roller is pressed against and into contact with the feed roller with a pressure applied between the feed roller and the reverse roller. The reverse roller is upwardly and elastically supported by an axis which is supported at one side thereof and that is rotated by a driving gear and a gear engaged with the driving gear. The reverse roller is supported at a free end side of the axis and is arranged via a torque limiter, so as to be rotated in a sheet feeding direction and a direction opposite the sheet feeding direction. The sheet feeding device further includes a pressing device configured to provide a cyclic change in the pressure between the feed roller and the reverse roller, and the pressing device is arranged at a side of the reverse roller. The pressing device may use a magnetic force, and the pressing device may provide the pressure change more than one time as the reverse roller makes one rotation.

According to another preferred embodiment of the present invention, a sheet feeding device includes a feed roller and a friction roller, wherein the friction roller is pressed against and into contact with the feed roller with a pressure applied between the feed roller and the friction roller. The friction roller is upwardly and elastically supported by an axis which is supported at one side thereof and which is rotated by a driving gear and a gear engaged with the driving gear. The friction roller is arranged at a free end side of the axis via a torque limiter, so as to be rotated only in a sheet feeding direction. The sheet feeding device further includes a pressing device configured to provide a cyclic change in the pressure between the feed roller and the friction roller, and the pressing device is arranged at a side of the friction roller. The pressing device may use a magnetic force, and the pressing device may provide the pressure change more than one time as the friction roller makes one rotation.

Each of the above sheet feeding devices may further include a sheet guiding member to regulate advancement of the sheets downstream of the feed roller in the sheet feeding direction.

Further, in each of the above sheet feeding devices, the feed roller, the separation member, and the pressing device, may be integrally constructed in an unit which is attachable to and detachable from an image forming apparatus.

According to another preferred embodiment of the present invention, an image forming apparatus includes an image forming device, and a sheet feeding device configured to convey a sheet to the image forming device. The image forming device forms an image on the sheet conveyed from the sheet feeding device. The sheet feeding device includes a feed roller and a separation member, wherein the separation member is pressed against and into contact with the feed roller with a pressure applied between the feed roller and separation member. A plurality of the sheets, conveyed between the feed roller and the separation member, are separated and conveyed one by one by the sheet feeding device to the image forming device. The sheet feeding device further includes a pressing device configured to cyclically provide a change in the pressure between the feed roller and the separation member.

According to another preferred embodiment of the present invention, an image forming apparatus includes an image forming device, and a sheet feeding device configured to convey a sheet to the image forming device. The image forming device forms an image on the sheet conveyed from the sheet feeding device. The sheet feeding device includes a feed roller and a reverse roller pressed against and into contact with the feed roller with a pressure applied between the feed roller and the reverse roller. The reverse roller is upwardly and elastically supported by an axis which is supported at one side thereof and which is rotated by a driving gear and a gear engaged with the driving gear. The reverse roller is supported at a free end side of the axis and arranged via a torque limiter, so as to be rotated in a sheet feeding direction and a direction opposite the sheet feeding direction. A plurality of the sheets, conveyed between the feed roller and the reverse roller, are separated and are conveyed one by one to the image forming device. The sheet feeding device further includes a pressing device configured to provide a cyclic change in the pressure applied between the feed roller and the reverse roller, and the pressing device is arranged at a side of the reverse roller.

According to still another preferred embodiment of the present invention, an image forming apparatus includes an image forming device, and a sheet feeding device configured to convey a sheet to the image forming device, and the image forming device forms an image on the sheet conveyed from the sheet feeding device. The sheet feeding device includes a feed roller and a friction roller, wherein the friction roller is pressed against and into contact with the feed roller with a pressure applied between the feed roller and the friction roller. The friction roller is upwardly and elastically supported by an axis which is supported at one side thereof and which is rotated by a driving gear and a gear engaged with the driving gear. The friction roller is arranged at a free end side of the axis via a torque limiter, so as to be rotated only in a sheet feeding direction. A plurality of the sheets conveyed, between the feed roller and the friction roller, are separated and are conveyed one by one to the image forming device. The sheet feeding device further includes a pressing device configured to provide a cyclic change in the pressure between the feed roller and the friction roller, and the pressing device is arranged at a side of the friction roller.

According to another preferred embodiment of the present invention, a method of forming an image on a sheet includes the steps of: conveying a plurality of the sheets between a feed roller and a separation member, wherein the separation member is pressed against and into contact with the feed roller with a pressure applied between the feed roller and the separation member; separating and conveying the sheets conveyed between the feed roller and the separation member one by one to an image forming device, wherein a cyclic change is provided in the pressure applied between the feed roller and the separation member; and forming the image on the conveyed sheet with the image forming device.

In the above method, the cyclic change in the pressure may be provided from a side of the feed roller. Further, the cyclic change in the pressure may be provided at a low frequency. Furthermore, the feed roller may be cyclically pressed for providing the cyclic change in the pressure.

BRIEF DESCRIPTION OF THE DRAWINGS

A more complete appreciation of the present invention and many of the attendant advantages thereof will be readily obtained as the same becomes better understood by reference to the following detailed description when considered in conjunction with accompanying drawings, wherein.

DETAILED DESCRIPTION OF THE PREFERRED EMBODIMENTS

Figure 1:
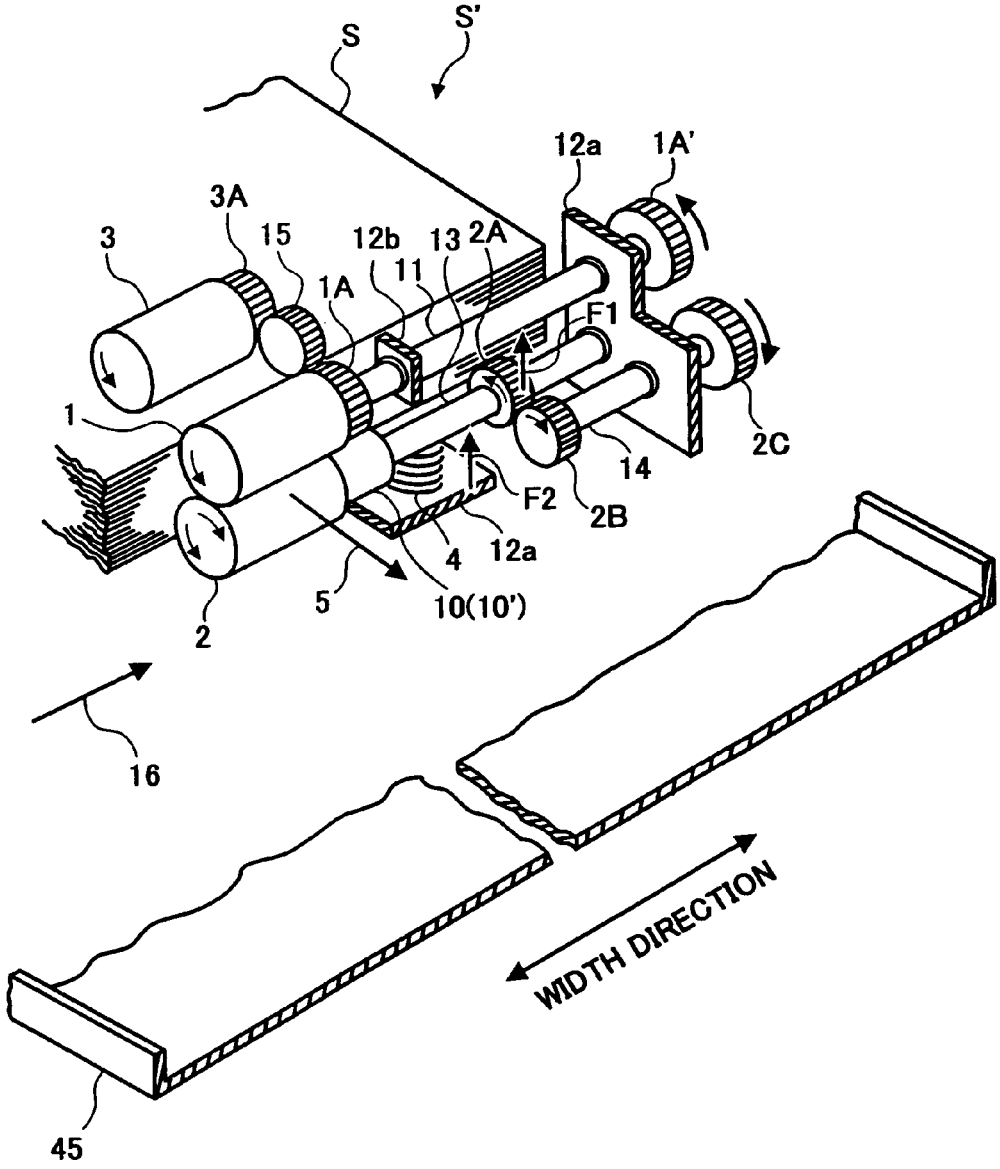
FIG. 1 is a partial schematic perspective view illustrating a sheet feeding device of an FRR type, in which a separating member is a reverse roller rotatable in forward and backward directions via a torque limiter.

Referring now to the drawings, wherein like reference numerals designate identical or corresponding parts throughout the several views, preferred embodiments of the present invention are described.

First, three types of a sheet feeding devices, according the present invention, are described, namely, the feed and reverse rollers (FRR) type, the friction roller (FR) type, and the friction pad (FP) type. In each of the three types, sheets are conveyed between a feed roller and a separation member, wherein the separation member is pressed against and into contact with the feed roller, and the sheets, which are sandwiched therebetween, are separated by differences in the coefficients of friction between the feed roller and the separation member, between the sheets, and between the sheet and the separation member.

FIG. 1 is a partial schematic perspective view illustrating a sheet feeding device of the FRR type, in which a separating member is a reverse roller rotatable in forward and backward directions via a torque limiter. In FIG. 1, a reference character S denotes a sheet and a reference character S' denotes stacked sheets. The stacked sheet S' are aligned along a supporting member (not shown) of the sheet feeding device, and the sheet feeding device is configured so that the position of an uppermost sheet of the stacked sheets S' is constantly maintained at a predetermined position, even when the stacked sheets S' have been decreased as the uppermost sheet S is fed out one by one or the sheets S have been replenished. Reference numeral 5 denotes a sheet feeding direction. Under the force of its own weight, a pick-up roller 3 contacts an upper surface of the uppermost sheet S of the stacked sheets S' at the downstream side of the sheet S in the sheet feeding direction 5 and in the center of a width direction of the sheets S perpendicular to the sheet feeding direction 5.

A feed roller 1 and a reverse roller 2 contact and face each other. The feed roller 1 and the reverse roller 2 are arranged so as to oppose the pick-up roller 3 near the end part of the stacked sheets S' in the sheet feeding direction 5. The nip portion, between the feed roller 1 and the reverse roller 2, is positioned at the same level as that of the uppermost sheet S of the stacked sheets S'.

The feed roller 1 has a central longitudinal axis 11 which is supported at one side thereof by a main body side plate 12*a* of the sheet feeding device and a bracket 12*b*. The bracket 12*b* is an integral part of the main body side plate 12*a*. The axis 11 penetrates through the main body side plate 12*a*, and a gear 1A' is fixed at the end of the axis 11. The gear 1A' engages a driving gear (not shown) for feeding and conveying the sheet S.

The reverse roller 2 has a central longitudinal axis 13 which is supported by the main body side plate 12*a* at one side thereof, and the reverse roller 2 is provided at the end of the axis 13 via a torque limiter 10. The axis 13 is supported by a flexible spring 4 near the torque limiter 10. The reverse roller 2 is pressed toward the feed roller 1 by a pressing force of the spring 4.

A gear 2A is fixed on the axis 13 between the torque limiter and the main body side plate 12*a*. The gear 2A engages a gear 2B. The gear 2B has a central longitudinal axis 14.

The axis 14 penetrates through the main body side plate 12*a* so as to be supported by the main body side plate 12*a* on the side opposite the side on which the gear 2B is provided. A gear 2C is fixed to the end part of the axis 14. The gear 2C also engages the driving gear (not shown) for conveying the sheet S.

A gear 3A is an integral part of the pick-up roller 3 and a gear 1A is an integral part of the feed roller 1. The gear 3A and the gear 1A engage each other via an idle gear 15.

In FIG. 1, when viewed in the direction of arrow 16, the gear 1A' is configured so as to receive a driving force in the counterclockwise direction. The gear 2C is configured to receive a driving force in the clockwise direction. Therefore, the gear 2A, which is at a driven side, receives an upwardly directed force F1 applied at the gear teeth surface of the engaged part of the gear 2A from the gear 2B, which is at a driving side. The reverse roller 2 is elastically pressed to contact the feed roller 1 with a nip pressure NP by the upwardly directed force F1 and an upwardly directed pressing force F2 of the spring 4. This relationship is expressed by the equation, as follows: NP=F1+F2.

Because the gear 1A, the idle gear 15, and the gear 3A engage each other, the pick-up roller 3 and the feed roller 1 rotate in the counterclockwise direction to feed out the sheet S in the sheet feeding direction 5. The reverse roller 2 is connected to the axis 13 via the torque limiter 10, and rotates together with the axis 13 when a given load, applied on the reverse roller 2, is within a range exceeding a predetermined value. However, when the given load is equal to or smaller than the predetermined value or exceeds the range, the reverse roller 2 is idle relative to the axis 13. Accordingly, when a load smaller than a predetermined torque, is provided on the reverse roller 2, the reverse roller 2 is rotated by the feed roller 1, and rotates in the clockwise direction.

When feeding the stacked sheet S', the uppermost sheet S of the stacked sheets S' is fed out by the pick-up roller 3 in the sheet feeding direction 5. When only one sheet S of the stacked sheets S' is separated so as to be fed, because the load provided on the reverse roller 2 is relatively small, the reverse roller 2 is rotated by the feed roller 1, and the uppermost sheet S is fed out in the sheet feeding direction 5.

When a plurality of the stacked sheets S' are fed into the nip portion of the feed roller 1 and the reverse roller 2, the reverse roller 2 is loaded so as to be rotated in the reverse direction opposite the sheet feeding direction 5 via the torque limiter 10. Thereby, the sheet S, contacting the reverse roller 2, is returned and only the uppermost sheet S is separated so as to be conveyed in the sheet feeding direction 5.

However, when a contacting force, between the stacked sheets S' which have been fed together, is greater than a returning force of the reverse roller 2 to return the uppermost sheet S contacting the reverse roller 2, the stacked sheets S' may not be separated and conveyed together. The present invention provides a method and a device to decrease the contacting force between sheets in advance so that double feeding of the sheets is avoided.

Figure 2:
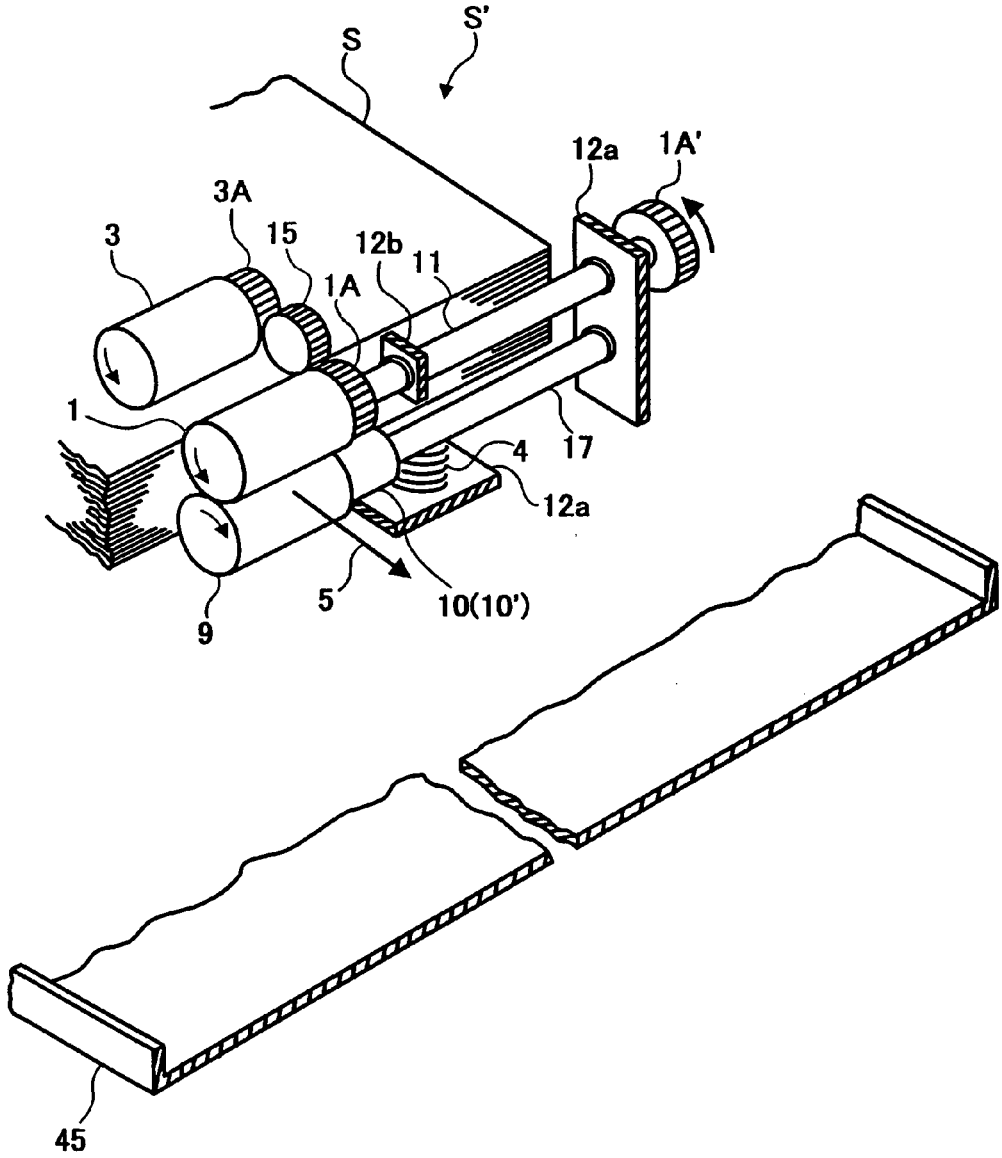
FIG. 2 is a partial schematic perspective view illustrating a sheet feeding device of a FR type, in which a separating member is a friction roller that rotates or stops rotating via a torque limiter.

FIG. 2 is a partial schematic perspective view illustrating a sheet feeding device of the FR type, in which a separating member is a friction roller which rotates or stops rotating via a torque limiter.

In FIG. 2, the same parts as those of the sheet feeding device of FIG. 1 are denoted by the same reference characters, and the description thereof is omitted. The sheet feeding device of FIG. 2 includes a friction roller 9 in place of the reverse roller 2 of FIG. 1.

The friction roller 9 is supported on an axis 17 at one side thereof via a torque limiter 10. The axis 17 is fixed to a main body side plate 12*a*. A spring 4 supports the axis 17 elastically and upwardly at a free end side and from below the axis 17. Unlike the example of FIG. 1, the axis 17 is not provided with the gears 2B and 2C for reverse rotation thereof.

An uppermost sheet S of the stacked sheets S' is fed out by a pick-up roller 3. When only one sheet S of the stacked sheets S' is separated and fed, because a load applied to the friction roller 9 is small, the friction roller 9 is rotated by the feed roller 1 to convey the uppermost sheet S in a sheet feeding direction, as in the FRR type feeding device.

A plurality of the sheets S may sometimes be fed into a nip between the feed roller 1 and the friction roller 9. When a plurality of the stacked sheets S' are fed into the nip, the friction roller 9 is stopped from being rotated by the feed roller 1 by the torque of the torque limiter 10, and the friction roller 9 stops the stacked sheets S' (other than the uppermost sheet S to be fed), so that the stacked sheets S' are separated and conveyed one by one.

However, when the contacting force between the stacked sheets S' that are fed together is greater than a force of the friction roller 9 to return the stacked sheets S', the stacked sheets S' may not be separated and may be fed together.

Figure 3:
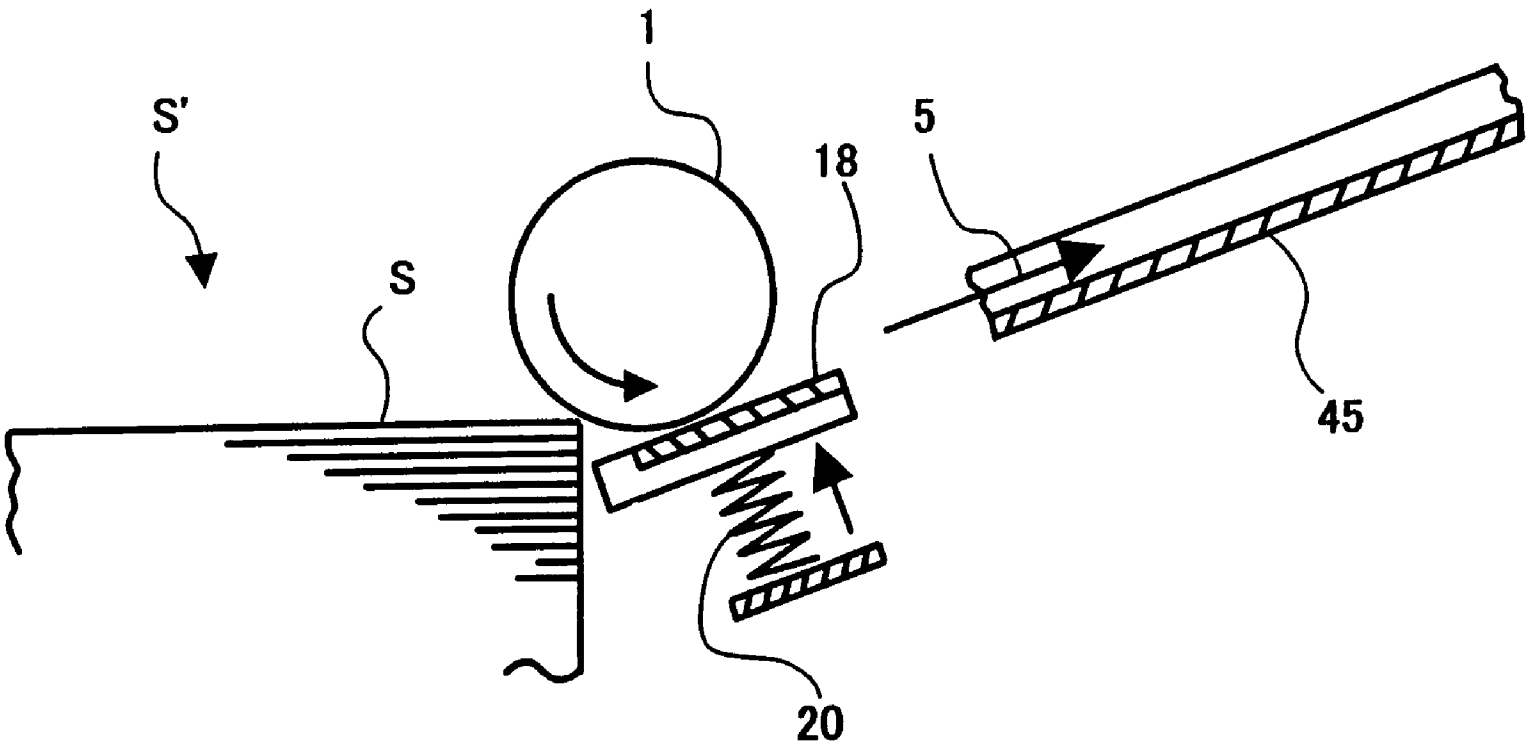
FIG. 3 is a partial schematic side elevational view illustrating a sheet feeding device of a FP type, in which a separation member is a friction pad pressed against and contacting a feed roller.

FIG. 3 is a partial schematic side elevational view illustrating a sheet feeding device of the FP type, in which a separation member is a friction pad pressed against and contacting a feed roller.

In the sheet feeding device of FIG. 3, a pick-up roller is not provided. A feed roller 1 is pressed against and is in contact with a leading end of a sheet S in the sheet feeding direction, and a friction pad 18 is pressed against and in contact with the feed roller 1 by a spring 20 having an elasticity.

An uppermost sheet S of stacked sheet S' is fed into a nip part of the feed roller 1 and the friction pad 18 by the feed roller 1. When a plurality of the stacked sheets S' are fed into the nip, the stacked sheets S' are separated and fed one by one by differences in the friction coefficients between the feed roller 1 and the stacked sheet S', the coefficient of friction between the stacked sheets S', and the coefficient of friction between the uppermost sheet S of the stacked sheets S' and the friction pad 18. In this case also, when the contacting force between the sheets of the stacked sheets S' is large, the sheets of the stacked sheets S' may be fed together.

According to the present invention, in any of the above-described sheet feeding devices, with respect to double fed sheets S at a nip part of a feed roller and a separation member, a cyclic change is provided in a pressure between the feed roller and the separation member, such that a closely contacting state of the double fed sheets S is loosened and thereby double feeding of the sheets is avoided. It is preferable to cyclically press the feed roller against the separation member. However, when the feed roller cannot be cyclically pressed against the separation member, the separation member may be cyclically pressed against the feed roller.

The separation member here may be any one of the reverse roller 2, the friction roller 9, and the friction pad 18 of FIGS. 1-3. The effect of loosening the sheets S can be great when the cyclic change in the pressure between the feed roller and the separation member is provided from the side of the feed roller, because the pressure change between the feed roller and the separation member is directly conveyed to the sheet S to be separated from other sheets to be fed.

Figure 17:
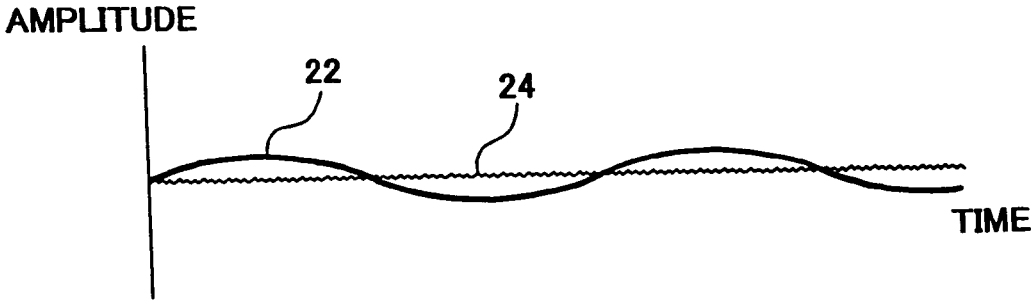
FIG. 17 is a graph explaining a difference between a cycle of providing a pressure change and a vibration by a piezo-element.

Therefore, in the sheet feeding devices of FIGS. 1, 2, and 3, because the sheet S to be separated from other sheets to be fed is the uppermost one of the stacked sheet S', the feed roller 1 is cyclically pressed downward. In other words, the cyclic change in the pressure is provided by vertically oscillating either the shaft of the feed roller 1 or the shaft of the separation member (i.e. reverse roller 2). The term "cyclic" or "cyclically" as used herein means a constant repetition, and the cycle of pressing the feed roller 1 may be, for example, as indicated by a curve 22 of FIG. 17, which shape is in a sine curve and is different from that of a waveform 24 of vibration generated by a piezo-electric element. A good sheet loosening effect is obtained with the pressing cycle of a low frequency, for example, with a pressing cycle lower than about several hundreds Hz, preferably with the pressing cycle of about 40 Hz with the amplitude of about 0.1 mm, and thereby double feeding of the sheets S is avoided.

Figure 16:
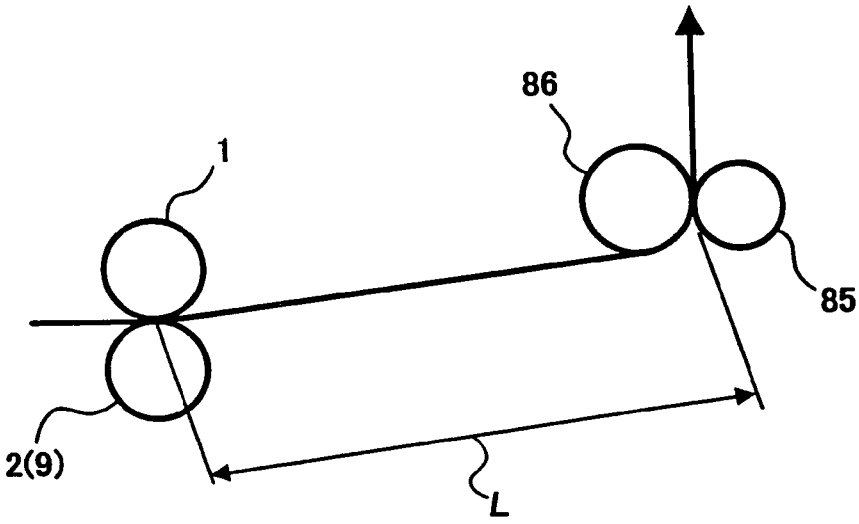
FIG. 16 is a side elevational view explaining an interval between a feed roller and a nearest conveying roller.

The lower limit of the pressing cycle is determined by a distance "L" between a nip part of the feed roller 1 and the reverse roller 2, the reverse roller 2 acting as the separation member, and a roller 85 or 86 (see FIG. 16), which is nearest to the nip part downstream of the nip part, and the sheet conveying speed of the sheet feeding devices. This is because, within a time "t" in which a rear end of a sheet is conveyed by the distance L, the subsequent sheet must be separated. Therefore, at least one pressure change must be provided during the time "t" to the pressure between the feed roller 1 and the reverse roller 2. That is, the lower limit of the pressing cycle for the feed roller 1 may be determined such that at least one pressure change is provided, while a rear end of a sheet fed from the nip part between the feed roller 1 and the separation member (the nip part between the feed roller 1 and the reverse roller 2) is being conveyed to a conveying member (the roller 85 or 86), which is nearest to the nip part downstream of the nip part in the sheet feeding direction. The upper limit of the pressing cycle is about several hundreds of Hz as described above.

Now, a pressing device that provides a cyclic change in the pressure between a feed roller and a separation member is described.

First, an example in which a pressing device is provided at the side of the feed roller is described.

Figure 4:
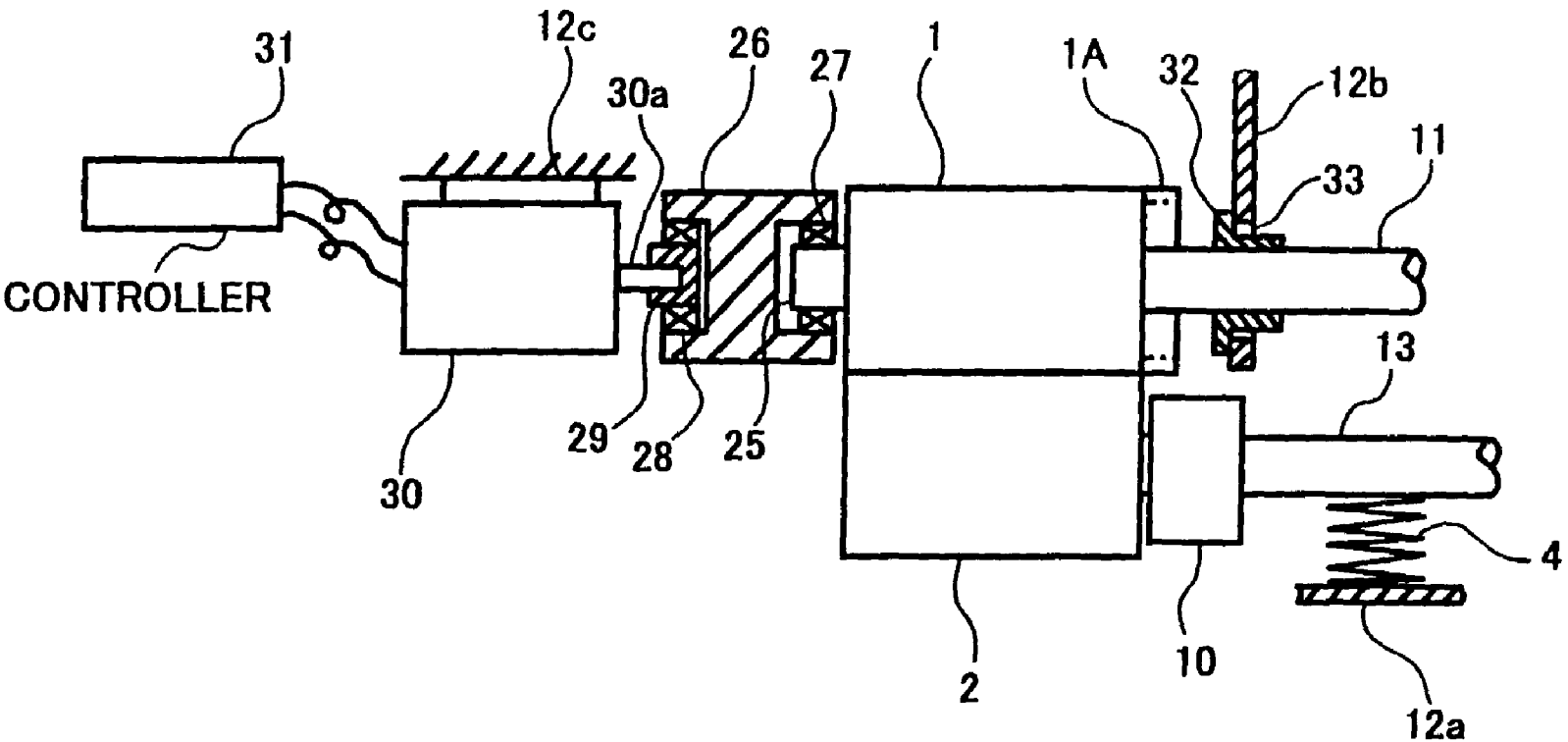
FIG. 4 is a partial schematic side elevational view illustrating a sheet feeding device having the structure illustrated in FIG. 1 and in which a pressing device, using an eccentric cam, is provided to a feed roller.

FIG. 4 is a partial schematic side elevational view illustrating a sheet feeding device having substantially the same construction as the sheet feeding device in FIG. 1 and in which a pressing device, using an eccentric cam, is provided to a feed roller. In FIG. 4, with respect to the feed roller 1, an axis 25 is provided on the same axis as that of the axis 11 at the side opposite the bracket 12*b*, and the axis 25 engages an end part of a joint 26 via a bearing 27.

Figure 5:
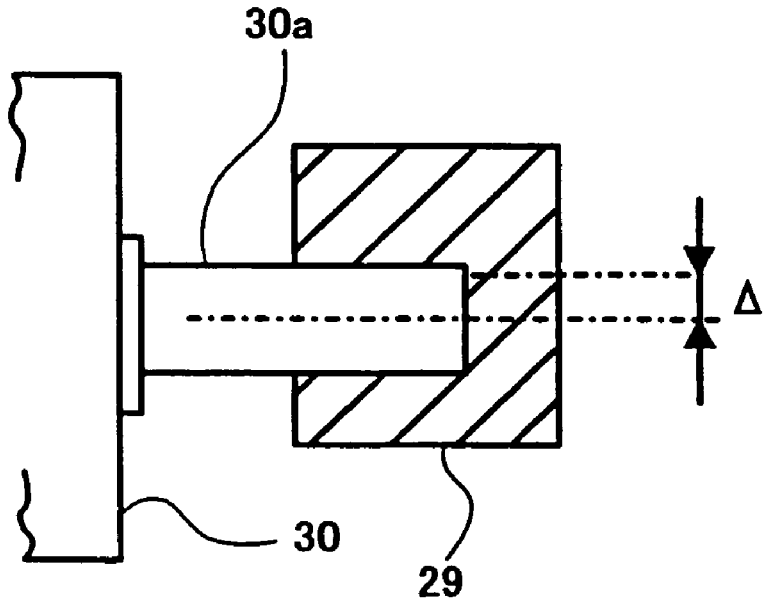
FIG. 5 is a partial cross-sectional view of the eccentric cam of FIG. 4.

Another end part of the joint 26 supports an eccentric cam 29 via a bearing 28. The bearing 27 and the bearing 28 are provided on the same core. As illustrated in FIG. 5, the eccentric cam 29 is fixed to a rotation axis 30*a* of a DC motor 30 at an eccentric position. The eccentric quantity Δ of the eccentric cam 29 is determined according to a predetermined pressure change, which is approximately 0.05 mm in this example.

In FIG. 4, the motor 30 functions only as the pressing device. The motor 30 is provided independently from a driving system of the feed roller 1, and is fixed to a frame 12*c*, which is integral with the main body side plate 12*a*. The motor 30 is connected to a controller 31 by a conductive wire, so that the rotation speed of the motor 30 can be changed, and further, driving or non-driving of the motor 30 can be selected by the controller 31.

Figure 6:
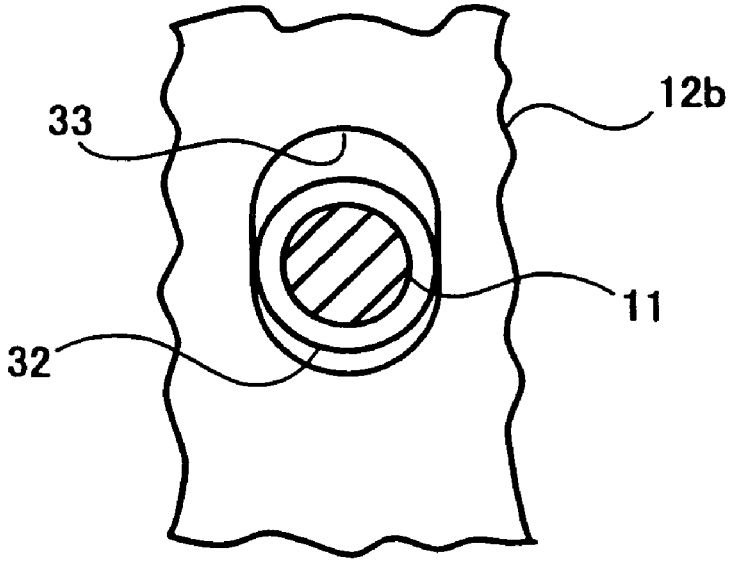
FIG. 6 is a top plan view explaining a long hole allowing the feeding roller to be dislocated in upward and downward directions.

The axis 11 is supported by the bracket 12*b* via the bearing 32. As illustrated in FIGS. 4 and 6, a long hole 33 is formed in the bracket 12*b* and is elongated in upward and downward directions. The bearing 32 slidably engages the long hole 33.

When the motor 30 is driven, the joint 26 is displaced, according to the eccentric quantity, as the motor 30 rotates. Because of the long hole 33, the axis 11 moves only in upward and downward directions. Thereby, the axis 11 is displaced in upward and downward directions, thus providing a pressure change to the reverse roller 2. Thus, in this example, a cyclic pressure change is provided by an eccentric cam, which is inexpensive.

Further, in this example, because the motor 30, functioning as the driving source for the pressing device, is provided independently from driving of a sheet feeding and conveying system of the sheet feeding device, a cyclic pressure change is obtained independently from driving or non-driving of the sheet feeding and conveying system. Therefore, even when the sheet feeding device is configured such that sheets wait at a nip part between the feed roller 1 and the reverse roller 2, for example, the pressure change is continued to be provided, so that loosening of the sheets is continued and thereby the separation performance is enhanced.

When the pressing device, using an eccentric cam, is operated, noise is generated by the eccentric cam. However, because the motor 30 can be selectively driven by the controller 31, the pressing device can be operated only when double feeding of sheets may occur, depending upon the humidity condition or the kind of sheets, etc. When the humidity condition or the kind of sheets is such that double feeding of the sheets might not occur without operating the pressing device, the pressing device can be selected not to be operated. Thus, the provision of a pressure change can be stopped when noise by the operation of the pressing device is not desirable. Further, when deterioration of the image quality due to vibration by the provision of the pressure change is not desirable, or when accurate feeding of sheets is required, the provision of a pressure change can be stopped. Thus, the sheet feeding device can be used for a variety of needs.

In this embodiment, because an eccentric cam, driven by a motor, is used, as the rotation speed of the motor 30 is increased, the cycle of pressure change is shortened, and as the rotation speed of the motor 30 is reduced, the cycle of the pressure change is elongated. When the motor 30 is a direct current or DC motor, as the control voltage value is increased at the controller 31, the rotation speed of the motor 30 is increased, so that the cycle of pressure change is shortened and vise versa. Thus, according to the kind of sheets or the environmental condition, by appropriately selecting the rotation speed of the motor 30, the condition to avoid double feeding of sheets can be set.

The above embodiment has been described with respect to a sheet feeding device of the FRR type in which a pressing device, using a cam, is applied to the feed roller 1, referring to FIG. 4. However, such a pressing device, using a cam, can be applied to other sheet feeding devices of the FR type illustrated in FIG. 2 or the FP type illustrated in FIG. 3.

Further, the sheet feeding devices of the FRR type, illustrated in FIG. 1, or the FR type, illustrated in FIG. 2, obtain a bounding effect by the spring 4 when the pressing device provides a pressure change, thereby increasing the effect of reliably separating sheets. Similarly, the sheet feeding device of the FP type, illustrated in FIG. 3, obtains a bounding effect by the spring 20.

For example, in FIG. 1, when the frequency in a specific range is selected for the pressure change by the pressing device, the spring 4 cannot follow the upward and downward movement of the feed roller 1, i.e., the cycle of upward and downward movement of the feed roller 1 deviates from that of the reverse roller 2. When the feed roller 1 is moved downwardly when the spring 4 is extended, a nip pressure, larger than when the upward and downward cycle of the feed roller 1 agrees with that of the reverse roller 2, is temporarily generated. Such an effect of obtaining a larger pressure change is referred to as the bounding effect. The above specific range of frequency may be, for example, from about 20 Hz to about 200 Hz.

Figure 7:
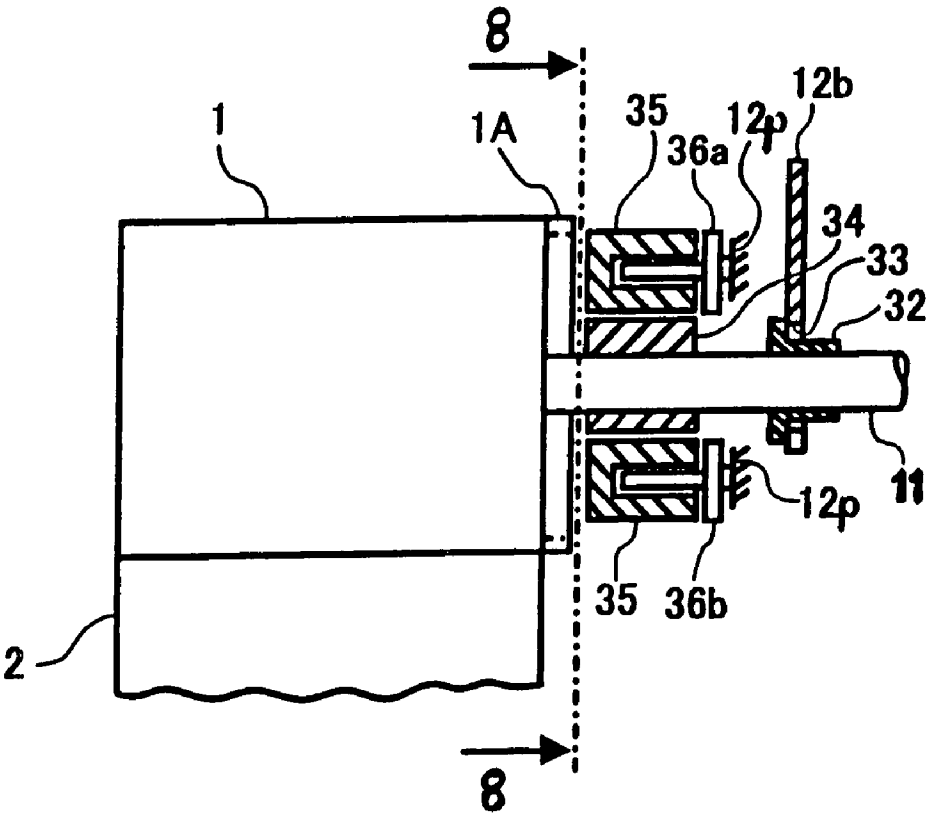
FIG. 7 is a partial schematic side elevational view illustrating a sheet feeding device having the structure illustrated in FIG. 1 and in which a pressing device, using an odd-numbered polygonal cam, is used.

FIG. 7 is a partial schematic side elevational view illustrating a sheet feeding device having the structure illustrated in FIG. 1, in which a pressing device, using an odd-numbered polygonal cam, is used. In FIG. 7, with respect to the feed roller 1, the axis 11 at the side of the bracket 12*b* is supported by the bearing 32 as in FIG. 4 and FIG. 5, and the bearing 32 is supported by the bracket 12*b* via the long hole 33.

A regular pentagonal cam 34 having five sides and five corners is fixed to the axis 11. Rollers 35 are supported by axis parts 36*a* and 36*b* above and below the cam 34. The axis parts 36*a* and 36*b* are fixed at 12*p* as shown in FIG. 7.

Figure 8:
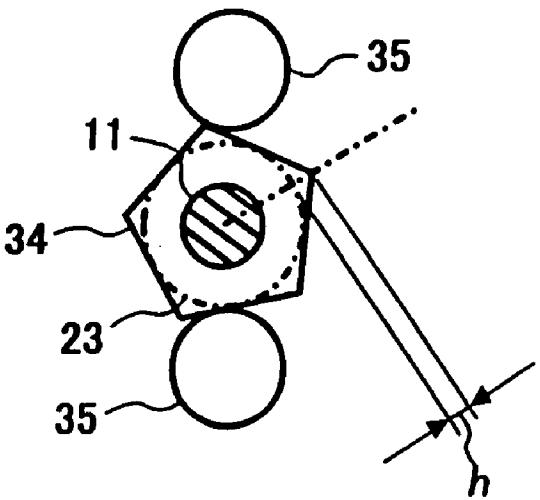
FIG. 8 is a cross-sectional view taken along line 8-8 of FIG. 7.

FIG. 8 is a partial cross-sectional view taken along line 8-8 of FIG. 7. In FIG. 8, the rollers 35 contact a flat part of the cam 34. The cam 34 is formed such that a distance "h" is defined from each corner thereof to a surface of an inscribed virtual circle 23 on a line connecting the corner and the center of the circle. When the cam 34 rotates due to one of the corners of the cam 34 being pressed downwardly by the upper roller 35, the lower roller 35 contacts one of the flat parts of the cam 34, and when one of the corners is pressed upwardly by the lower roller 35, the upper roller 35 contacts one of the flat parts of the cam 34.

Accordingly, each time the cam 34 rotates 180 degrees, the axis 11 is displaced upwardly and downwardly by a distance corresponding to the height "h". Thereby, a cyclic pressure change is provided to the reverse roller 2.

In this embodiment, the cam 34 is integral with the axis 11. Therefore, the cam 34 is driven by a power from the gear 1A' of FIG. 1 and FIG. 2. Accordingly, a dedicated power source for the pressing device, such as a motor, is not required.

The above embodiment has been described with respect to a sheet feeding device of the FRR type, in which a pressing device, using a cam, is applied to the feed roller 1, such as the one shown in FIG. 4. However, such a pressing device using a cam can be applied to other sheet feeding devices of the FR type, as illustrated in FIG. 2, or the FP type, as illustrated in FIG. 3.

Further, the sheet feeding devices of the FRR type, as illustrated in FIG. 1, or the FR type, as illustrated in FIG. 2, obtain a bounding effect from the spring 4 when the pressing device provides the pressure change, thereby increasing the effect of reliably separating sheets. Similarly, the sheet feeding device of the FP type, as illustrated in FIG. 3, obtains a bounding effect from the spring 20.

Figure 9:
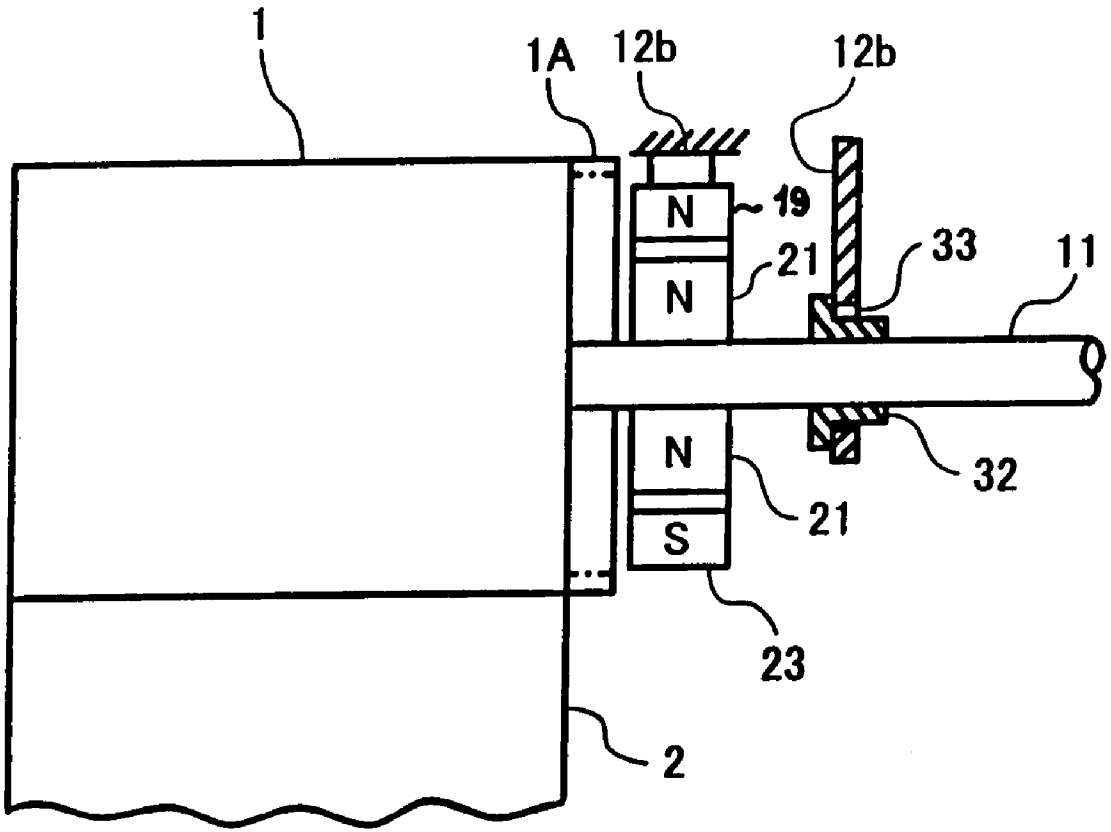
FIG. 9 is a partial schematic side elevational view illustrating a sheet feeding device having the structure illustrated in FIG. 1 and in which a pressing device, using a magnetic power, is provided.

FIG. 9 is a partial schematic side elevational view illustrating a sheet feeding device having the structure illustrated in FIG. 1, in which a pressing device, using a magnetic power, is provided. In FIG. 9, with respect to the feed roller 1, the axis 11 at the side of the bracket 12*b* is supported by the bearing 32, as shown in FIGS. 4 and 6, and the bearing 32 is supported by the bracket 12*b* via the long hole 33.

A rotating element 21 is integrally provided to the axis 11. The rotating element 21 includes four poles, which are arranged such that another north or N pole and another south or S pole are alternately provided and the same kind of poles oppose each other, as is illustrated in both FIGS. 10 and 11. Further, the rotating element 21 is fixed to the bracket 12*b*, which is integral with the main body side plate 12*a*, such that a fixed north or N pole 19 and a fixed south or S pole 23 are positioned above and below, respectively, the rotating element 21 so as to oppose each other.

Figure 10:
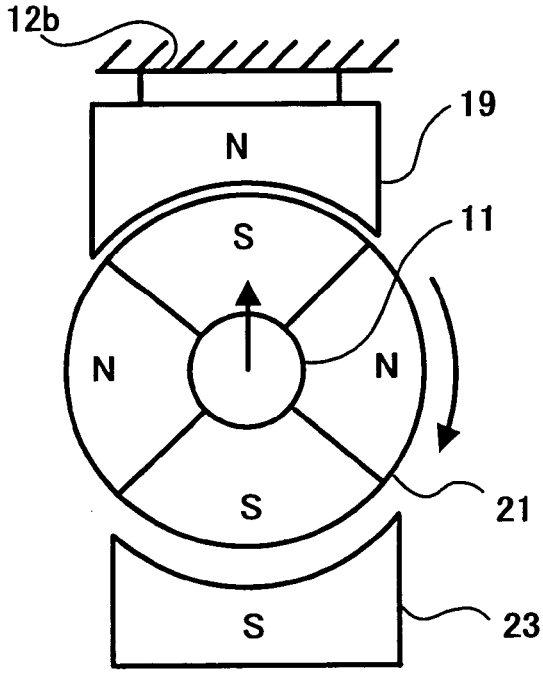
FIG. 10 is a front view explaining a relationship between magnetic poles at a rotating position of an axis of a feed roller.
Figure 11:
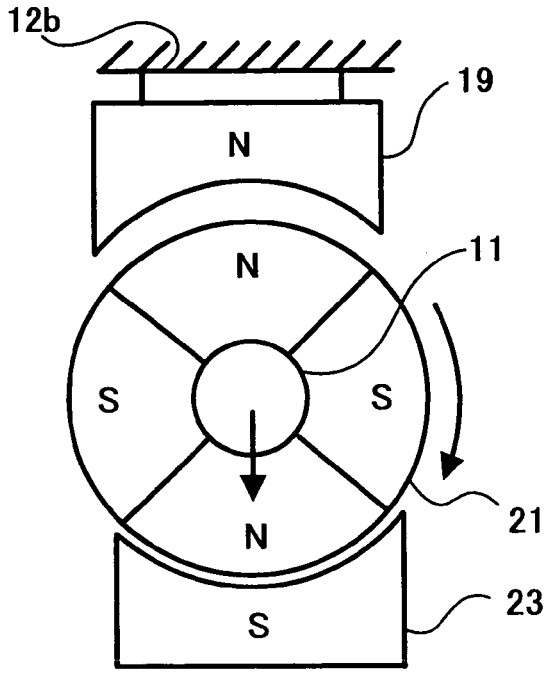
FIG. 11 is a front view explaining a relationship between the magnetic poles at another rotating position of the feed roller axis.

As illustrated in FIG. 10, when the upper south or S pole of the rotating element 21 opposes the upper fixed north or N pole 19 above the rotating element 21, the lower south or S pole of the rotating element 21 opposes the lower fixed south or S pole 23, and thereby the axis 11 receives a upwardly directed magnetic force so as to be moved upwardly. As illustrated in FIG. 11, when the rotating element 21 rotates 90 degrees from the position illustrated in FIG. 10, the upper north or N pole of the rotating element 21 opposes the upper fixed north or N pole above the rotating element 21 and when the lower north or N pole of the rotating element 21 opposes the lower fixed south or S pole 23 below the rotating element 21, so that the axis 11 receives a downwardly directed magnetic force to be moved downwardly.

Accordingly, each time the axis 11 rotates by 90 degrees, the axis 11 is displaced by alternating upwardly and downwardly directed magnetic forces and thereby, the reverse roller 2 is provided with a cyclic pressure change.

In this embodiment, the rotating element 21 is integral with the axis 11. Therefore, the rotating element 21 is driven by a power from the gear 1A' shown in FIGS. 1 and 2. Accordingly, a dedicated power source for the pressing device, such as a motor, is not required.

The above embodiment has been described with respect to a sheet feeding device of the FRR type in which a pressing device, using a cam, is applied to the feed roller 1, illustrated in FIG. 4. However, such a pressing device using a cam can be applied to other sheet feeding devices of the FR type, illustrated in FIG. 2, or the FP type, illustrated in FIG. 3.

Further, the sheet feeding devices of the FRR type, illustrated in FIG. 1, or the FR type, illustrated in FIG. 2, obtain a bounding effect from the spring 4 when the pressing device provides the pressure change, thereby increasing the effect of reliably separating sheets. Similarly, the sheet feeding device of the FP type, illustrated in FIG. 3, obtains a bounding effect from the spring 20.

Now, an example, in which the pressing device is provided at the side of a reverse roller, is described. The example can also be applied to sheet feeding devices of the FRR type, illustrated in FIG. 1, and of the FR type, illustrated in FIG. 2.

Figure 12:
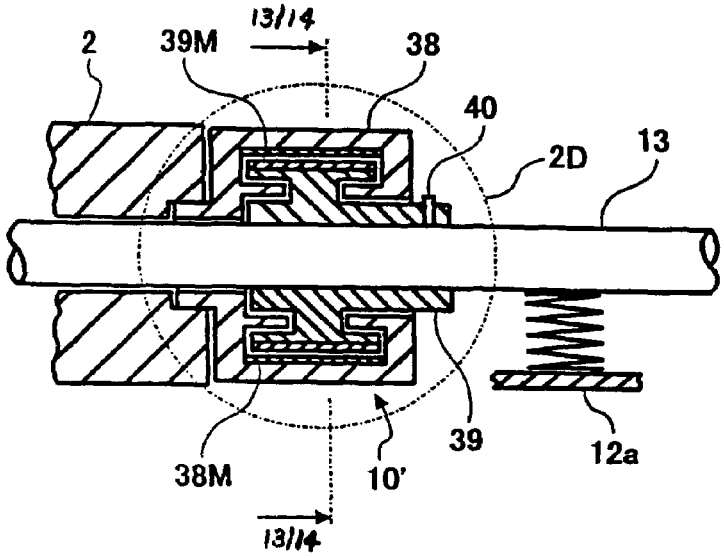
FIG. 12 is a cross-sectional view of a sheet feeding device in which a pressing device is provided at the side of a reverse roller.
Figure 13:
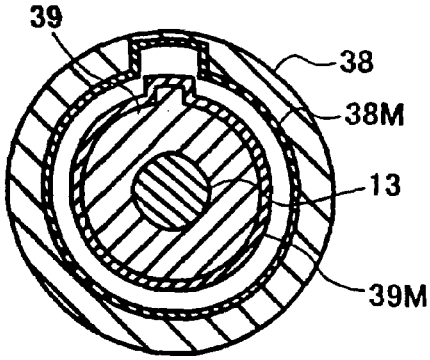
FIG. 13 is a cross-sectional view of the sheet feeding device taken along line 13/14-13/14 of FIG. 12.
Figure 14:
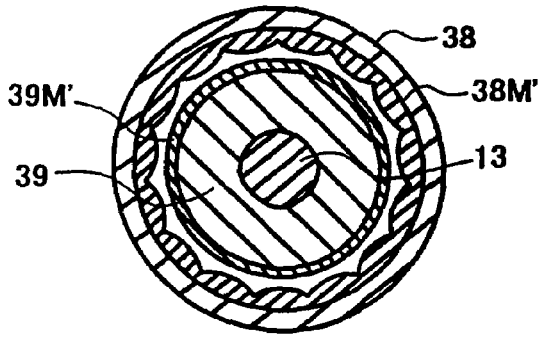
FIG. 14 is another cross-sectional view of the sheet feeding device taken along line 13/14-13/14 of FIG. 12.

FIGS. 12-14 are cross-sectional views illustrating a sheet feeding device of the FRR type, as illustrated in FIG. 1, in which a pressing device, providing a cyclic change in the pressure between a feed roller and a reverse roller, is arranged at the side of a reverse roller.

In FIG. 12, a torque limiter 10', functioning as a pressing device, is provided on the axis 13. A housing 38 of the torque limiter 10' is freely rotatable relative to the axis 13, and is integral with the reverse roller 2. The reverse roller 2 is freely rotatable relative to the axis 13.

The housing 38 is tube-shaped, and a rotating element 39, having a circular shape, is arranged in a tube-shaped part of the housing 38 so as to be rotatable. The rotating element 39 is made integral with the axis 13 by a pin 40. The outer circumference of the rotating element 39 and the inner circumference of the housing 38 oppose each other via a space, and the housing 38 is freely rotatable relative to the rotating element 39. Magnets 39M and 38M are provided on the outer and inner circumferences, respectively, of the rotating element 39.

Magnetic forces, of both the magnet 38M and the magnet 39M, generate torque provided on the reverse roller 2. By changing the space between the magnet 38M and the magnet 39M, the torque can be cyclically changed, and thereby the nip pressure (NP) between the feed roller 1 and the reverse roller 2 can be changed.

In FIG. 1, as described above, a relationship, namely, NP=F1+F2, holds true, and the force F1 is determined by the torque of the torque limiter 10'. Therefore, when the magnetic forces of both the magnet 38M and the magnet 39M cyclically change, the nip pressure NP between the feed roller 1 and the reverse roller 2 cyclically changes.

FIG. 13 is a cross-sectional view of the sheet feeding device taken along line 13/14-13/14 of FIG. 12. As illustrated in FIG. 13, in the magnet 39M, a convex part is formed at a part of the outer circumference thereof, and in the magnet 38M, a concave part is formed at a part of the inner circumference thereof. With this configuration of the magnets 38M and 39M, the nip pressure NP changes as the reverse roller 2 makes one rotation.

FIG. 14 is another cross-sectional view of the sheet feeding device taken along line 13/14-13/14. A large number of convex and concave parts are formed at the circumference of the magnet 38M', and the magnet 39M' has a circumferential surface. With this configuration of the magnets 38M' and 39M', as the reverse roller 2 makes one rotation, the nip pressure NP can be changed a number of times corresponding to the number of convex and concave parts formed at the circumference of the magnet 38M'.

The important feature of this embodiment is that the nip pressure NP between the feed roller 1 and the reverse roller 2 changes and the physical distance between the feed roller 1 and the reverse roller 2 does not change. The cyclic change in the pressure that acts on double-fed sheets in the nip part of the feed roller 1 and the reverse roller 2 loosens the sheets closely contacting each other, and thereby double feeding of the sheets is avoided.

In this embodiment, the pressing device uses a magnetic force. Therefore, an existing torque limiter can be used with a slight change in its construction and without affecting the outer dimension thereof, so that an additional space for the pressing device is not required and thereby, the sheet feeding device, incorporating the pressing device, is not enlarged. Further, because the driving system, for a sheet conveying mechanism that drives the reverse roller 2, is used for a driving source of the pressing device, an extra driving source is not required specially for the pressing device.

In the above embodiment, the description has been made for a sheet feeding device of the FRR type, as illustrated in FIG. 1. However, the pressing device according to the above embodiment, can be used in a sheet feeding device of the FR type, as illustrated in FIG. 2, so that the nip pressure, between the feed roller 1 and the friction roller 9, can be changed and thereby, double feeding of sheets is avoided.

As in the previous embodiment, because the pressing device uses a magnetic force, an existing torque limiter can be used with a slight change in its construction and without affecting the outer dimension thereof, so that an additional space for the pressing device is not required and thereby, the sheet feeding device, incorporating the pressing device, is not enlarged. Further, because the driving system, for a sheet conveying mechanism that drives the friction roller 9, is used for a driving source of the pressing device, an extra driving force is not required specially for the pressing device.

In each of the above-described embodiments, skewing of the sheet S may be caused by provision of a cyclic change in the pressure between the feed roller 1 and a separation member. In this respect, as illustrated in FIGS. 1-3, a guide 45 is provided downstream of the feed roller 1 to regulate and correct deviation of the sheet S in the width direction, so that skewing of the sheet S is prevented.

Figure 15:
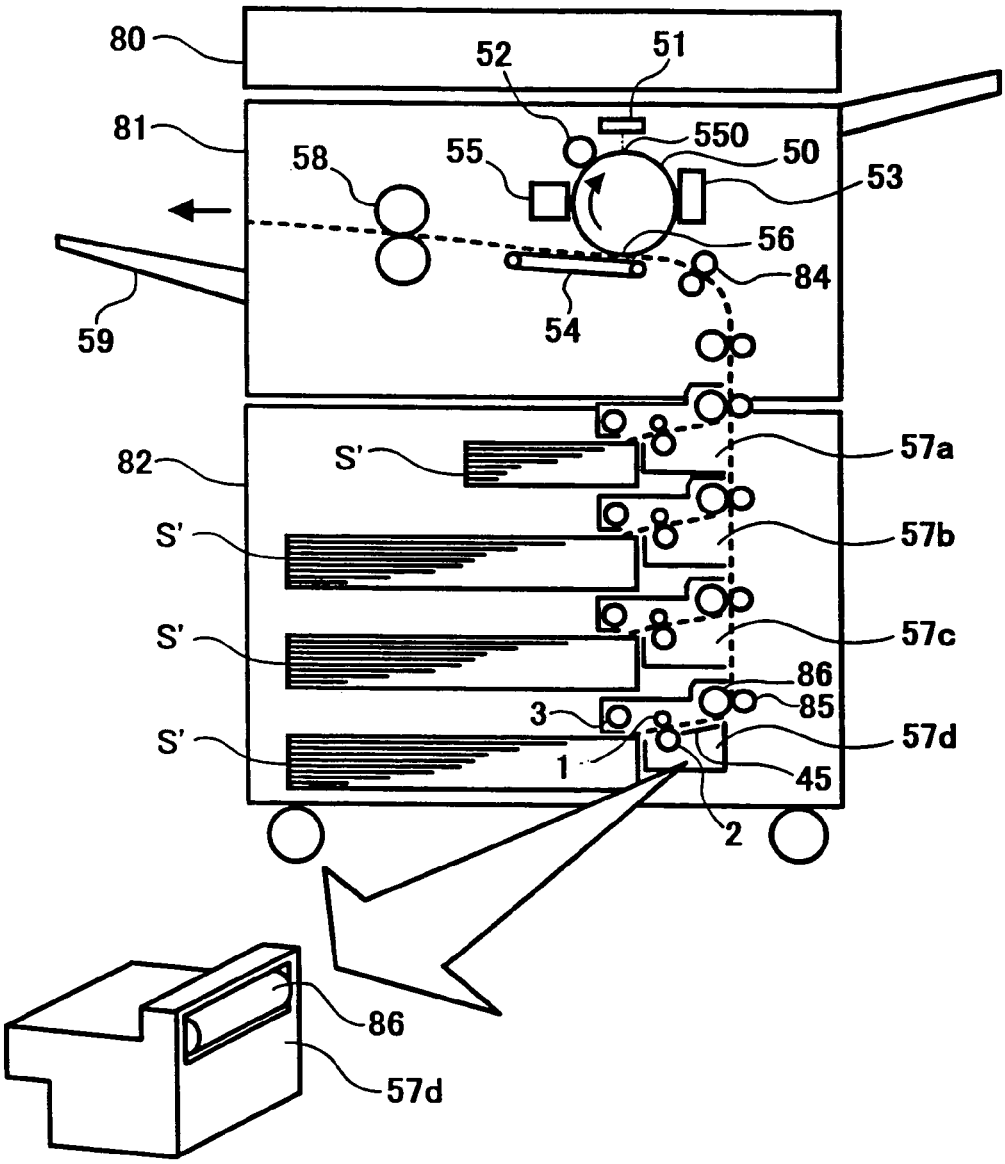
FIG. 15 is a schematic side elevational view illustrating an image forming apparatus in which a sheet feeding device of the present invention is applied.

FIG. 15 is a schematic side elevational view illustrating an image forming apparatus in which a sheet feeding device, of any of the above-described embodiments, can be applied. As illustrated in FIG. 15, the image forming apparatus includes an image reading part 80, an image forming part 81, and a sheet accommodation part 82. The image reading part 80 reads an image of an original, coverts read information to an electric signal, and sends the signal to a control device (not shown) for writing the information.

The image forming part 81 includes an image bearing member 50 having a photosensitive layer formed on the circumferential surface of a drum-shaped rotating member. The circumferential surface of the image bearing member 50 constitutes a surface to be scanned by an optical writing device (described later) of the image forming part 81.

Around the image bearing member 50, in a rotating direction thereof as indicated by a curved arrow in the figure, a charging roller 52, acting as a charging device, an optical scanning device 51, acting as the optical writing device, a developing device 53, a conveying belt 54, and a cleaning device 55, are all arranged.

A light beam is irradiated from the optical scanning device 51 onto a part of the image bearing member 50 between the charging roller 52 and the developing device 53, so that the image bearing member 50 is scanned by the beam in the main scanning direction, which is parallel to a rotation axis of the image bearing member 50 (the direction vertical to the sheet surface).

The part of the image bearing member 50 where the beam is irradiated is referred to as an exposure part 550. A transfer roller (not shown), acting as a transfer device, is arranged below the image bearing member 50 so as to contact the image bearing member 50 via a conveying belt 54. The part of the image bearing member 50 contacting the transfer roller is referred to as a transfer part 56. A fixing device 58 is arranged on the left side of the conveying belt 54, as viewed in FIG. 15, and a discharge tray 59 is arranged on the left side of the fixing device 58.

The main part of the image forming apparatus is constituted by the optical scanning device 51, the developing device 53, the transfer roller (not shown) provided at the transfer part 56, the cleaning device 55, and the fixing device 58, wherein the cleaning device 55 and the fixing device 58 are arranged around the image bearing member 50.

The sheet accommodation part 82 includes four sheet feeding devices 57*a*, 57*b*, 57*c*, 57*d* vertically overlaying each other. Each of the sheet feeding devices 57*a*, 57*b*, 57*c* and 57*d* may have any one of the configurations described above. Further, a sheet conveying path is formed from each of the sheet feeding devices 57*a*, 57*b*, 57*c* and 57*d* leading to the image forming part 81, as indicated by a dotted line in the figure.

A conveying guide (not shown) is provided to guide a sheet from each of the sheet feeding devices 57*a*, 57*b*, 57*c* and 57*d* toward a registration roller 84.

For example, an uppermost sheet S of the stacked sheets S' stacked in the sheet feeding device 57*d* is separated from the stacked sheets S', and is conveyed to the transfer part 56 passing the conveying guide and the registration roller 84. An image is transferred onto the sheet S at the transfer part 56, and the sheet S is discharged to the discharge tray 59 via the fixing device 58. As the sheet conveying path, other paths, such as a manual feeding path or a reversed feeding path for both-side copying, may be arranged. However, the description thereof is omitted because of no direct relevancy to the present invention.

In the image forming apparatus, image formation is performed as described below.

The image bearing member 50 first starts to rotate and then, the charging roller 52 uniformly and negatively charges the surface of the image bearing member 50 in the dark, as the image bearing member 50 rotates. A light beam is irradiated onto the exposure part 550 to be scanned and thereby, the electric charge, at the irradiated part of the image bearing member 50, is eliminated, so that an electrostatic latent image, corresponding to an image to be formed, is formed. The latent image then reaches the developing device 53 by rotation of the image bearing member 50, where the latent image is visualized so as to be formed into a toner image.

The developing device 53 visualizes the latent image on the image bearing member 50 by applying toner, having a positive polarity, to the latent image. The image forming system in this embodiment uses a so-called negative-to-positive developing system, in which the image bearing member 50 is negatively charged and toner, of a positive polarity, is used for development.

After formation of the toner image, a sheet S starts to be conveyed by the pick-up roller 3 at a predetermined feeding time, and the conveyed sheet S is temporarily stopped at a pair of registration rollers 84 via the conveying path, indicated by the dotted line in the figure, where the sheet S waits to be conveyed, so as to coincide with the toner image on the image bearing member 50 at the transfer part 56. The sheet S stopped at the registration rollers 84 is fed out by the registration rollers 84 when the above predetermined feeding time comes.

The leading edge of the sheet S, fed out by the registration rollers 84, then reaches the transfer part 56. The toner image, on the image bearing member 50, and the sheet S, thus conveyed, coincide with each other at the transfer part 56, and the toner image is transferred onto the sheet S by an electric field formed by the transfer roller.

The sheet S, on which the toner image has been transferred, passes the fixing device 58, where the toner image is fixed onto the sheet S, and the sheet S is then discharged to the discharge tray 59.

Residual toner on the image bearing member 50, that has not been transferred onto the sheet S at the transfer part 56, reaches the cleaning device 55, as the image bearing member 50 rotates. The residual toner is removed from the image bearing member 50 when passing the cleaning device 55, so that the image bearing member 50 is prepared for subsequent image formation.

In FIG. 15, for example, the sheet feeding device 57*d* is the FRR type sheet feeding device, as illustrated in FIG. 1, and includes the pressing device, as illustrated in FIG. 4. The guide 45 is arranged downstream of the nip part of the feed roller 1 and the reverse roller 2, and a pair of conveying rollers, a roller 85 at the side of the image forming apparatus and a roller 86 at the side of the sheet feeding device, are arranged downstream of the guide 45, so as to convey the sheet S.

In this embodiment, the feed roller 1, the reverse roller 2, which acts as a separation member, the guide 45, and the pressing device of FIG. 4, are all assembled into a unit, so as to constitute the sheet feeding device 57*d*.

As illustrated in FIG. 15, the sheet feeding device 57*d* is formed in a box shape, and an opening, which accords with the box shape, is formed in the main body of the image forming apparatus. The sheet feeding device 57*d* is freely attachable to and detachable from the opening. When the sheet feeding device 57*d* is attached to the main body of the image forming apparatus, the pick-up roller 3, the feed roller 1, and the reverse roller 2, are all in predetermined positions relative to stacked sheets S', and the roller 86 opposes and contacts the roller 85. In this embodiment, the main body side plate 12*a* of FIG. 1 corresponds to a frame of the sheet feeding device 57*d*.

By thus configuring a feeding device so as to be freely attachable to and detachable from an image forming apparatus, maintenance of the internal parts of the feeding device, such as the feed roller 1, the reverse roller 2, which act as a separation device, the guide 4, and the pressing device, illustrated in FIG. 4, can be easily performed by the user or the service person. Further, with respect to the image forming apparatus, a jammed sheet at the sheet feeding device can be easily removed.

Any of the feeding devices, other than the above-described RFR type or those having a pressing device other than the one using an eccentric cam, can be configured so as to be freely attachable to and detachable from an image forming apparatus, so that the above-described advantages can be obtained.

Now, the reason why provision of a predetermined cyclic change in the pressure between a feed roller and a separation member increases the separation performance of a sheet feeding device will be described.

Figure 18:
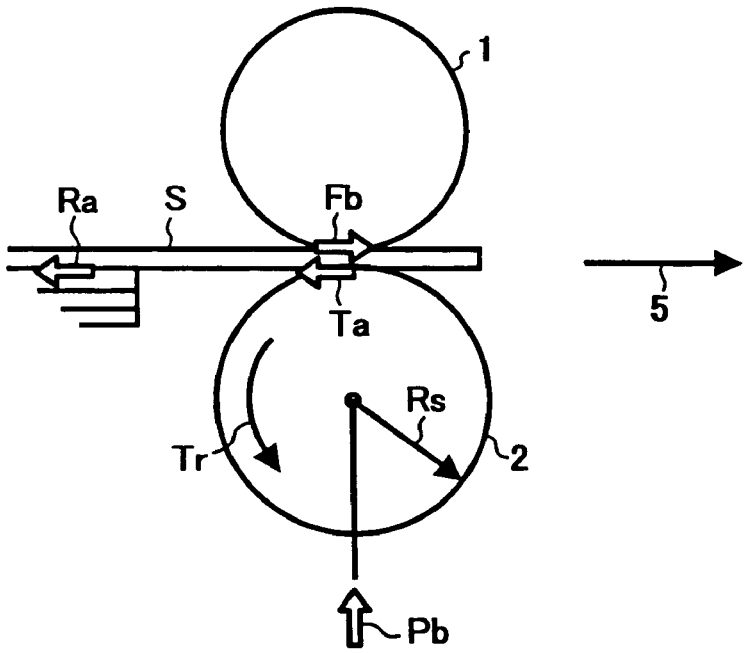
FIG. 18 is a partial schematic side elevational view explaining a force which acts on a sheet, when the sheet enters a nip between a feed roller and a reverse roller.
Figure 19:
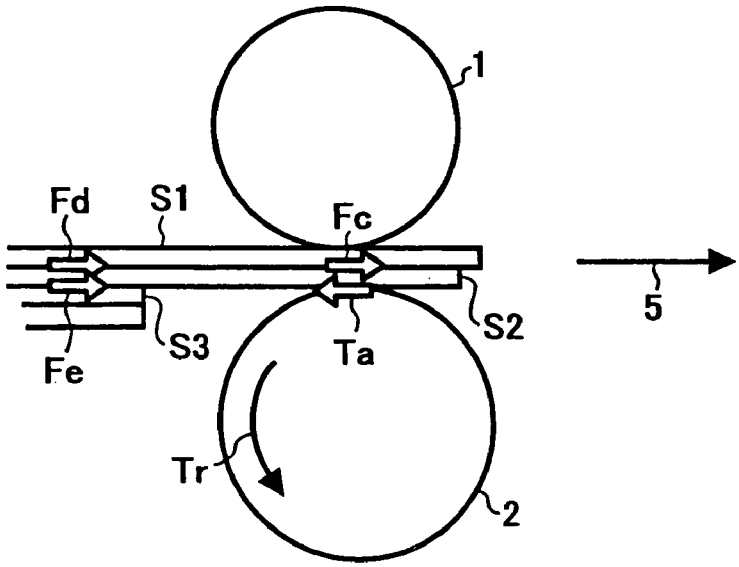
FIG. 19 is a partial schematic side elevational view explaining a force which acts on a sheet at a side of the reverse roller, when two sheets enter a nip between a feed roller and a reverse roller.

FIG. 18 is a partial schematic side elevational view for explaining about a force that acts on the sheet S, when the sheet S enters between the feed roller 1 and the reverse roller 2. FIG. 19 is a partial schematic side elevational view for explaining about a force that acts on the sheet S2 which is at the side of the reverse roller 2, when two sheets, i.e., a sheet S1 and a sheet S2, enter between the feed roller 1 and the reverse roller 2. In FIGS. 18 and 19, character Fb indicates a feeding force the feed roller 1 provides to the sheet S, character Fc indicates a feeding force the first sheet S1 provides to the second sheet S2, characters Fd and Fe indicate returning resistance forces between the sheets S1 and S2 and the sheets S2 and S3, character Tr indicates a torque of the limiter 10, character Ta indicates a torque limiter returning force, character Pb indicates a pressing force of the reverse roller 2 that presses the feed roller 1 when the reverse roller 2 is driven, character Ra indicates a resistance between the sheets S, and character Rs indicates a radius of the reverse roller 2.

In FIG. 18, the condition to feed one sheet S is expressed by the equation: Fb>Ta+Ra. Here, supposing that "m" is the mass of a sheet, μr is the coefficient of friction between a roller and the sheet, μp is the coefficient of friction between the sheets, because Fb=μr×Pb, and Ra=μp×mTa=Tr/Rs, the above condition to feed one sheet S can be expressed by the following equation:

$$Pb>(1/\mu r)Ta+(\mu p/\mu r)m \quad (1).$$

Further, in FIG. 19, the condition to separate the second sheet S2 from the first sheet S1 is expressed by Ta>Fc+Fd+Fe. Here, because Fc=μp×Pb, Fd=μp×m, and Fe=μp×2m, the above condition can be expressed as Ta>μp(Pb+3m). Therefore, the condition to separate the second sheet S2 from the first sheet S1 can be expressed by the following equation:

$$Pb<(1/\mu p)Ta-3m \quad (2).$$

When both of the above equations (1) and (2) are satisfied, the stacked sheets S' can be separated one after another so as to be conveyed one by one. Therefore, suppose that the area satisfying the above two equations is a satisfactory separation area, the satisfactory separation area can be expressed by the following equation:

$$(1/\mu p)Ta-3m>Pb>(1/\mu r)Ta+(\mu p/\mu r)m \quad (3).$$

Figure 20:
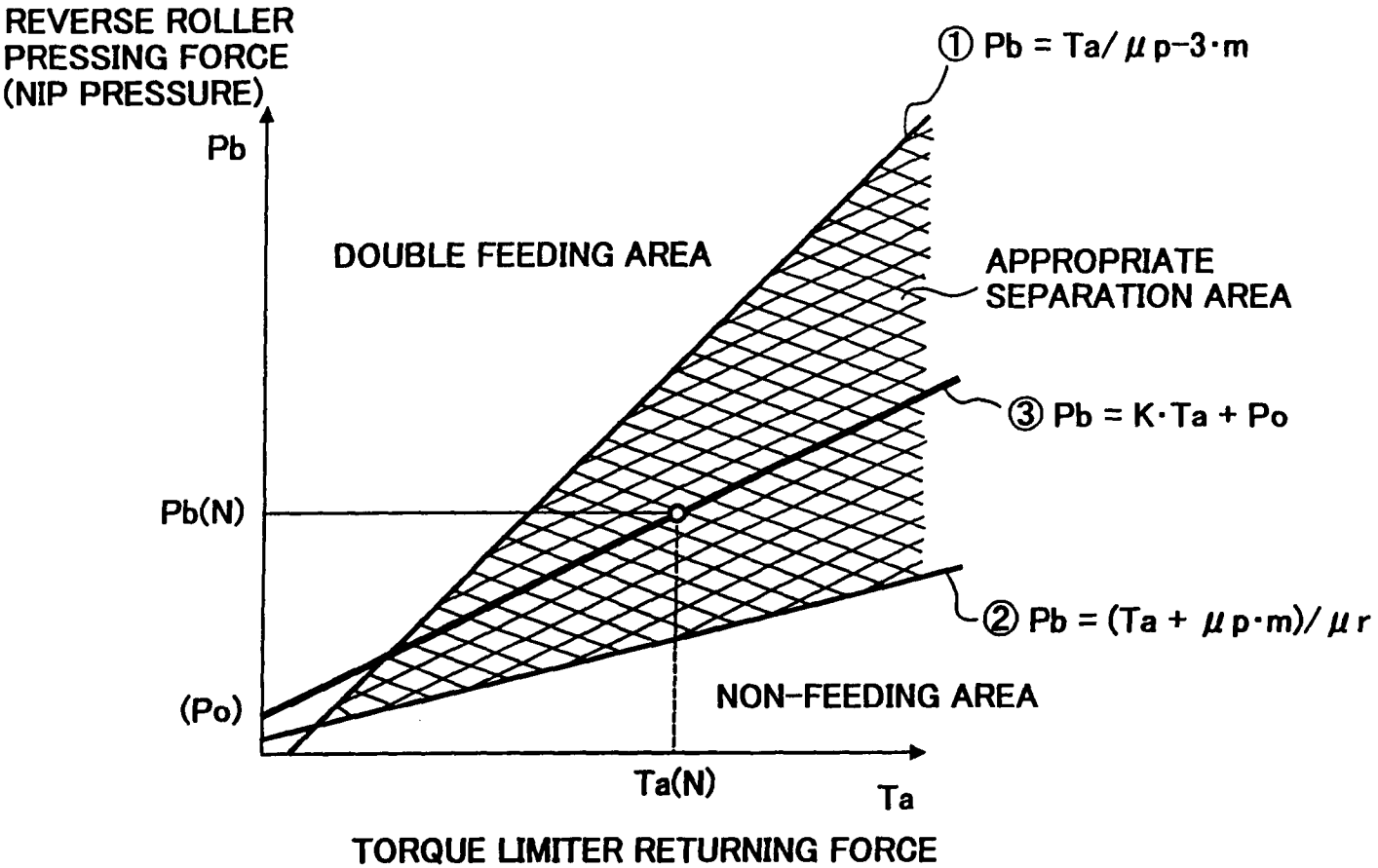
FIG. 20 is a graph explaining a relationship between a pressing force by a reverse roller and a returning force by a torque limiter, and illustrating an appropriate separation area, a double feeding area, and a non-feeding area.

In FIG. 20, the area above a straight line ① Pb=Ta/μp−3m is a double feeding area, and the area below the line ① is an area where double feeding does not occur. The area below a straight line ② Pb=(Ta+μp×m)/μr is a non-feeding area, and the area above the line ② is an area where non-feeding does not occur.

Accordingly, the area between the lines ① and ② is the appropriate separation area where double feeding and non-feeding do not occur.

A relation between a reverse roller pressing force Pb and a torque limiter returning force Ta is known to be expressed by the following equation (4):

$$Pb=K\times Ta+Po \quad (4),$$

which is indicated by a straight line ③ in the appropriate separation area of FIG. 20.

Here, Po is a reverse roller pressure when the reverse roller is not driven, and K is a constant peculiar to an apparatus.

When the torque limiter returning force Ta of the equation (4) is set so that the value of Pb is within the range satisfying the equation (3), the appropriate separation area of FIG. 20 is obtained, so that stable sheet separation and feeding is performed.

However, if sheets closely contact each other, Pb of the equation (3) is within the range expressed by the following equation (5):

$$(1/\mu p)Ta-3m-(Q1+Q2)/\mu p>Pb>(1/\mu r)Ta+(\mu p/\mu r)m+Q1/\mu r \quad (5),$$

wherein Q1 is a contacting force between the first sheet S1 and the second sheet S2 of FIG. 19, and Q2 is a contacting force between the second sheet S2 and a third sheet S3 of FIG. 19, so that the appropriate separation area is decreased and thereby double feeding or non-feeding occurs.

Figure 21:
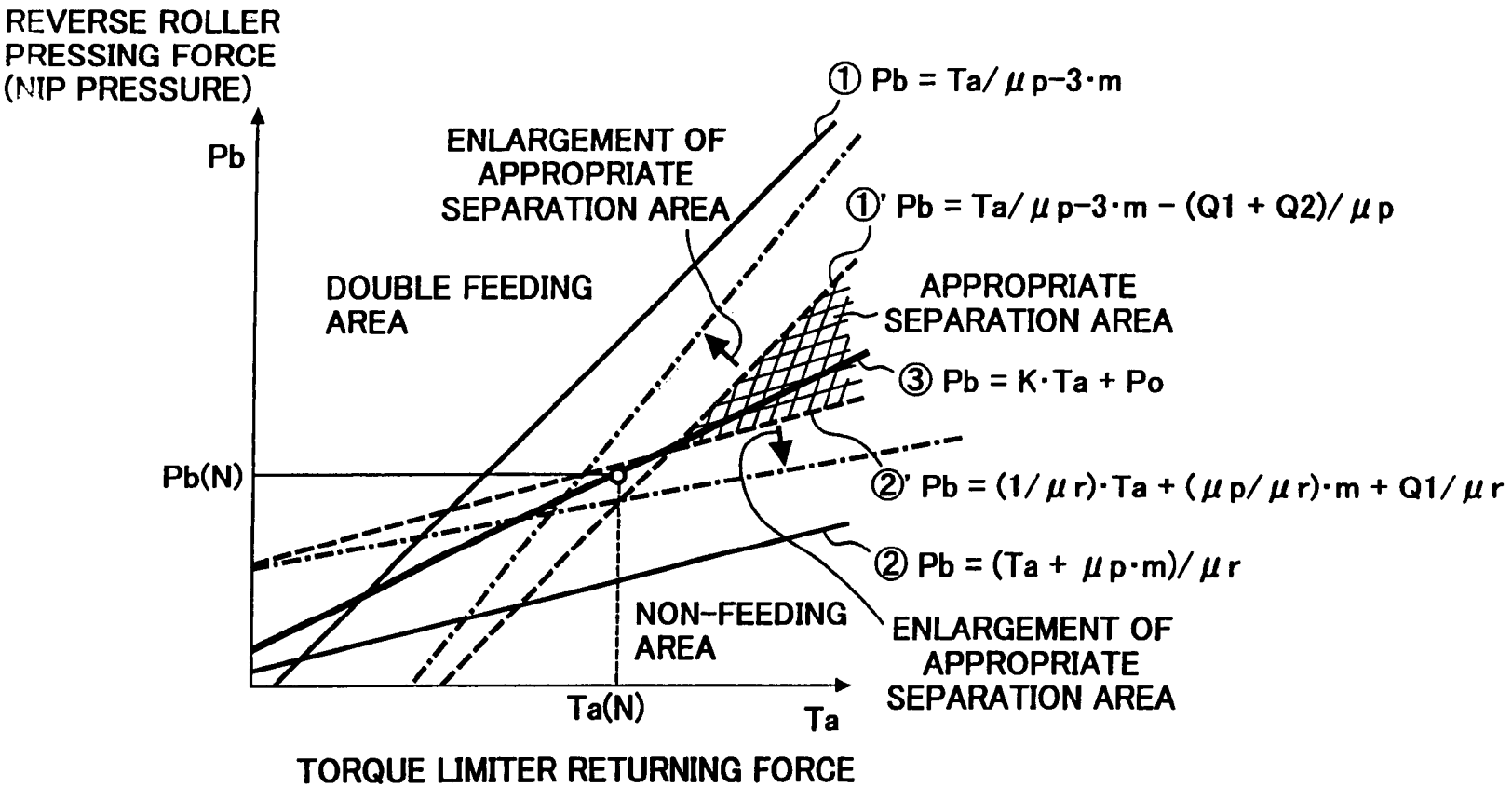
FIG. 21 is a graph explaining another relationship between the pressing force, applied by the reverse roller, and the returning force, applied by the torque limiter, and enlargement of the appropriate separation area.

FIG. 21 is a graph schematically illustrating the above-stated relationship. In FIG. 21, the straight line ① of FIG. 20 is shifted downwardly to a straight line ①' having the same inclination as that of the line ① and expressing an equation of the first degree:

$$Pb=Ta/\mu p-3m=(Q1+Q2)/\mu p.$$

Further, the straight line ② of FIG. 20 is shifted upwardly to a straight line ②' having the same inclination as that of the line ② and expressing an equation of the first degree:

$$Pb=(1/\mu r)Ta+(\mu p/\mu r)m+Q1/\mu r.$$

Accordingly, the appropriate separation area of FIG. 20 is decreased in FIG. 21, and the value of Pb, which is sufficiently within the appropriate separation area at the setting value Ta(N) of the torque limiter returning force of FIG. 20, is out of the appropriate separation area in FIG. 21 at the same the torque limiter returning force setting value Ta(N), so that double feeding or non-feeding occurs.

Here, if the value of Pb can be cyclically changed so as to be below the line ①' at one point and above the line ②' at another point, while the torque limiter returning force is kept at a same value, then when the Pb value is below the line ①', double feeding will not occur, although non-feeding may occur depending upon the Pb value, and when the Pb value is above the line ②', non-feeding will not occur, although double feeding may occur depending upon the Pb value.

Thus, by cyclically changing the value of Pb, which represents the pressing force of a separation member (the reverse roller 4) against the feed roller 1, even if the torque limiter returning force value Ta(N) is kept constant, the range of the pressing force where double feeding does not occur and the range of the pressing force where non-feeding does not occur are alternately obtained. As a result, the sheets are separated so as to be fed one by one.

Accordingly, even when the torque limiter returning force Ta is set at a value Ta(N) satisfying the condition to appropriately feed regular sheets and thereby, the appropriate separation area is limited as illustrated in FIG. 21 when special sheets having a large contacting force with each other, such as for example, ones having a smooth and flat surface or transparencies, are used, by alternately setting the value of Pb such that the value of Pb is below the line ①' and above the line ②', alternately, the appropriate separation area can be increased as indicated by arrows in FIG. 21, and thereby such special papers can be stably separated and fed.

Numerous additional modifications and variations of the present invention are possible in light of the above teachings. It is therefore to be understood that within the scope of the appended claims, the present invention may be practiced otherwise than as specifically described herein.

What is claimed as new and is desired to be secured by letters patent of the United States is:

1. An image forming apparatus, comprising:

an image forming device configured to form an image on a sheet;

a sheet feeding device configured to convey the sheet to said image forming device, said sheet feeding device includes an axis, a driving gear configured to rotate said axis and support said axis at one side thereof, a gear engaged with said driving gear, a feed roller, and a reverse roller upwardly and elastically supported by said axis and configured to be pressed against said feed roller at a pressure applied between said feed roller and said reverse roller, said reverse roller is supported at a free end side of said axis and disposed via a torque limiter, so as to be rotated in a sheet feeding direction and a direction opposite the sheet feeding direction; and a pressing device configured to provide a change in the pressure while the sheet is conveyed between said feed roller and said separation member such that a plurality of sheets conveyed between said feed roller and said reverse roller are separated and individually conveyed to the image forming device, said pressing device is positioned at a side of the reverse roller, wherein said pressing device is provided on the axis of the reverse roller and includes a housing and a rotating element rotatably provided in the housing, the housing has a first magnet provided on an inner circumference of the housing, the rotating element has a second magnet provided on an outer circumference of the rotating element, and the first magnet faces the second magnet and includes convex and concave parts such that a magnetic force between the first magnet and the second magnet are altered when the reverse roller is rotated.

* * * * *